US009340926B2

(12) United States Patent
Boujaada et al.

(10) Patent No.: US 9,340,926 B2
(45) Date of Patent: May 17, 2016

(54) WIRE GUIDE AND FLYER BOW COMPRISING SAID WIRE GUIDE

(75) Inventors: Mostafa Boujaada, Mably (FR); Denis Gianoncelli, Fourneaux (FR); Sophie Rondepierre, Fourneaux (FR)

(73) Assignee: SETIC SAS, Roanne (FR)

( * ) Notice: Subject to any disclaimer, the term of this patent is extended or adjusted under 35 U.S.C. 154(b) by 0 days.

(21) Appl. No.: 14/122,908

(22) PCT Filed: May 25, 2012

(86) PCT No.: PCT/IB2012/001023

§ 371 (c)(1),
(2), (4) Date: Feb. 24, 2014

(87) PCT Pub. No.: WO2012/164367

PCT Pub. Date: Dec. 6, 2012

(65) Prior Publication Data

US 2014/0196431 A1 Jul. 17, 2014

(30) Foreign Application Priority Data

May 27, 2011 (FR) ..... 11 01643

(51) Int. Cl.
*D07B 3/10* (2006.01)
*D07B 7/02* (2006.01)

(52) U.S. Cl.
CPC *D07B 3/103* (2013.01); *D07B 7/02* (2013.01); *D07B 2401/401* (2013.01); *D07B 2501/406* (2013.01)

(58) Field of Classification Search
CPC ..... D07B 3/103; D01H 7/30
USPC ..... 57/58.36, 58.63, 58.83, 67, 115, 116, 57/117, 118
See application file for complete search history.

(56) References Cited

U.S. PATENT DOCUMENTS

| | | | |
|---|---|---|---|
| 3,570,234 A | 3/1971 | Friesen et al. | |
| 6,223,513 B1 | 5/2001 | Post et al. | |
| 7,121,076 B2 * | 10/2006 | Priegelmeir et al. | 57/118 |

(Continued)

FOREIGN PATENT DOCUMENTS

| | | |
|---|---|---|
| CH | 618 486 | 7/1980 |
| EP | 1 612 325 | 1/2006 |
| JP | 58 125641 | 8/1983 |

(Continued)

OTHER PUBLICATIONS

International Search Report Issued Nov. 14, 2012 in PCT/IB12/001023 Filed May 25, 2012.

*Primary Examiner* — Shaun R Hurley
(74) *Attorney, Agent, or Firm* — Oblon, McClelland, Maier & Neustadt, L.L.P.

(57) ABSTRACT

A wire, strand, or cable guide element (EG) for a flyer bow for assembling/twisting/braiding the wire, strand, or cable has an inner surface (SI) which defines the travel path of the wire, strand, or cable (PF) and which consists of alternating adjacent micro-bumps (MB) and micro-recesses (MC). The flyer bow at least partially or entirely surrounds the wire, strand, or cable by means of a member (C) and has a longitudinal orifice or inner tube (O) in the mass of said member (C), said orifice or inner tube (O) extending along the entire length of the bow. The wire, strand, or cable guide element (EG) is accommodated within said orifice (O) so as to guide the longitudinal travel of the wire, strand, or cable.

16 Claims, 6 Drawing Sheets

(56) References Cited

U.S. PATENT DOCUMENTS

| | | | |
|---|---|---|---|
| 2006/0000198 | A1 | 1/2006 | Priegelmeir et al. |
| 2006/0196163 | A1 | 9/2006 | Voge et al. |

FOREIGN PATENT DOCUMENTS

| | | |
|---|---|---|
| JP | 63 183297 | 11/1988 |
| WO | 2006 094099 | 9/2006 |

* cited by examiner

WIRE GUIDE AND FLYER BOW COMPRISING SAID WIRE GUIDE

TECHNICAL FIELD

The invention relates to the technical field of "rotating machinery" with flyer bow intended for assembly of cables and twisting of wires or strands, especially those permitting the production of double or triple twists (so-called "braiding" operations).

It is recalled that this type of rotating machinery or flyer bow is well known to the person skilled in the art and is used in particular to twist individual wires to manufacture cables, especially cables intended to carry electricity, which require physical properties (tension, torsion, symmetry, etc.) of very high perfection.

Throughout the present application, including the claims, the generic term "cable" will be used to designate the cable or wire or strand intended to run or "travel" as it is well known in or along the longitudinal surface of the flyer bow (all with appropriate "guide" means, themselves also known as regards their principle), the rotating flyer bow functioning to impress a twist on this "cable", also in well known manner.

It is also known that the "cable" (or wire, etc.) arrives either from a winder (drum) or from another flyer bow combined with the first.

For a description of general aspects of flyer bows, the person skilled in the art will be able usefully to consult French Patent No. 9905435, non-limitatively.

A generic flyer bow is represented in the attached FIG. 1.

The present invention relates essentially to a means for guiding the "cable" (or wire, strand, etc., all referred to as "cable" for simplicity).

PRIOR ART

Devices exhibiting flyer bows made of composite fibers (mainly carbon and glass fiber), wood or steel are known.

In order to maintain the cable in position, the person skilled in the art has developed cable guide elements (especially grommets, eyelets) capable of holding the said cable at a certain number of points along the flyer bow.

Problems have occurred as a result of the fact that, since the flyer bow rotates at very high speed and the cable is not fixed, the latter may collide with the grommet walls, thus causing fragility in the cable, even capable of breaking it.

It must be well understood, in fact, that the person skilled in the art is generally confronted with a double movement (in combination), the first being the rapid travel of the cable along the flyer bow and the second (simultaneous and in combination, which produces the sought mechanical effect on the cable) being the rapid rotation of the flyer bow around an axis of rotation. It is also well known that, in general, the cable (or wire, strand, etc.) is led along the flyer bow at one end thereof, obviously in the direction of the said axis of rotation, and exits the flyer bow at the other end, also in the direction of the same axis of rotation of the flyer bow, for obvious reasons of kinematics.

In addition, the aerodynamics of the assembly comprising flyer bow, cable guide elements and cable is not absolutely optimum and, at the high speeds of rotation in question for the flyer bow, the resistance of the ambient air is very large, creating a strong drag that may be perturbed, with potentially very dangerous mechanical effects. This will also have the consequence that the motor of the flyer bow will consume more energy.

Another disadvantage will be that the repeated impacts on the cables as well as the "uncovered" path of the cable in the air stream will generate vibrations that are dangerous in themselves and, in addition, because of a pressure effect, a noise level that is too great for the operator.

The person skilled in the art has therefore searched for aerodynamic improvements of the shape of the flyer bow, especially to eliminate the grommets.

In this field there is known in particular U.S. Pat. No. 5,809,763 (Kamatics), which teaches a flyer bow having a cross section of improved aerodynamic shape, which in cross section will be referred to as a "drop" or "airfoil" shape, for better penetration through the air. The cable guide element is no longer external but is integrated in the flyer bow. For this purpose, the flyer bows are provided with a longitudinal orifice over their entire length, thus permitting passage of the cable through and in the interior of the flyer bow.

Since the cable passes through the flyer bow, the air no longer causes friction and the aerodynamic shape of the flyer bow permits good penetration through the air and therefore a reduction of motor power.

Energy savings are therefore achieved with limitation of the air friction.

Technical Problem Posed

Nevertheless, the creation of these aerodynamic flyer bows does not resolve one of the technical problems mentioned hereinabove: the fact that the cable may suffer wear and even break when the flyer bow is rotating at high speed.

In fact, even if the grommets were replaced by a longitudinal orifice integrated in the flyer bow, the cable remains "free" in this orifice and, when the flyer bow is set in rotation at high speed, the said cable will always collide (violently) with the walls of the "channel" made in the flyer bow, with the same consequences of wear, since the repeated impacts will cause deterioration of the cable.

Another disadvantage is that the worn cable creates debris (cable fragments dust), which will obstruct the orifice. Consequently, it is necessary to dismantle the flyer bow in order that this debris can be removed. Some prior art documents provide aeration systems, but these may prove ineffective and therefore useless.

In this field there is known U.S. Pat. No. 6,223,513 of Kamatics, which describes, in the context of such an aerodynamic flyer bow, a cable guide element 112 combined with air-pressure relief orifices 108. Cable guide 112 is expressly designed to comprise large spaces between the turns, so that the debris just mentioned is able to be easily dislodged therefrom. This is indicated as imperative in column 3 lines 5 to 7 "provided that "openings" (apertures, spaces) are made in the cable guide in order to permit the debris to leave ("exit") cable channel 106". It is noted that in this document there are provided orifices 108, 110 through which the air can escape by compression effect, thus creating a "fluid flow" in cable channel 106 "from a high-pressure zone toward the orifices", "without which the debris would accumulate in channel 106" (approximate summary of the bottom of column 2).

This document, very probably the closest prior art by far, therefore teaches forcing the debris to be ejected from the cable channel by the combination of broad spaces (see FIG. 3 in particular and the description such as "open wound spring" or spring with open turns in column 3 line 36), which leaves the debris more or less free by virtue of these deliberate and large spaces between the turns, with a differential flow of air that benefits from this degree of freedom of the debris between the turns in order to expel it, and also in combination with a high-pressure zone on "the intrados" 104 of the "airfoil" cross section (profile shaped like an airplane wing), creating a pressure differential by virtue of the low-pressure zone on "the extrados" 102, creating violent aspiration/ejection via the orifices 108, 110.

The guide 112 is described as a worn guide spring ("worn wire guide spring" 112 column 3 line 25) that may be easily removed from the longitudinal orifice and replaced by another, because naturally it is subjected to considerable wear.

This document does not absolutely prevent the formation of debris and therefore wear of the cable; its objective is solely to expel this debris more of less continuously.

A real need therefore exists to create a device of flyer bow type with which absence of wear of the cable can be guaranteed to the maximum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

GENERAL DESCRIPTION OF THE INVENTION

Figure 1:
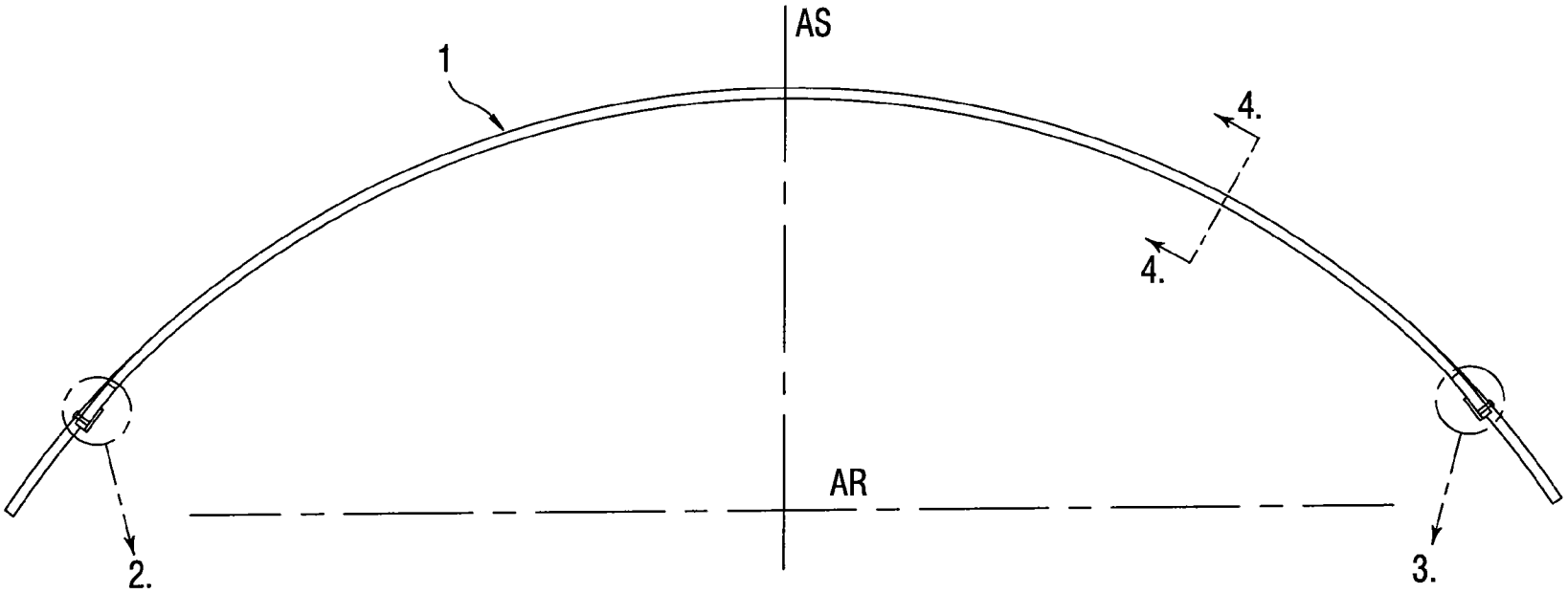
Fig. 1 PRIOR ART
FIG. 1 illustrates a known manner of rotating a flyer bow with an entry and an exit for the cable, wire, or strand.

The present invention relates to a device of flyer bow type of profiled shape with aerodynamic, preferably ovoid cross section, having:

- an internal orifice or tube or "channel" created all along the longitudinal axis of the said flyer bow, in the mass of the said flyer bow,
- an internal guide element disposed in this "internal tube" over the entire length of the flyer bow, adapted so that the cable runs in at one end and runs out at the other.

In a first step, a longitudinal recess is created in the cross section of the flyer bow (obviously the diameter of this recess is naturally larger than that of the cable), over the entire length thereof ("internal tube").

The guide element according to the invention, which is adapted to be inserted easily in this recess or "internal tube", is then inserted.

In order to maintain this guide element in position, it is fixed at the ends by any known means, especially by a screw-type fastening element.

The inside diameter of the internal tube, the outside diameter of the guide element and the outside diameter of the "cable" will obviously be optimized so that the guide element is held lightly in position in the internal tube and so that the "cable" has only a minimum vibration space.

These concepts of simple geometry will be obvious to the person skilled in the art.

The invention therefore relates to a flyer bow of the type described hereinabove, the essential characteristic of which lies in a guide element that is a preferably metallic element of the type spring with "closed" turns, in other words without spaces between them. The turns are therefore adjacent. This is exactly the inverse of the solution with "open" turns of U.S. patent '513 of Kamatics.

In addition, the present invention does not necessarily employ orifices 108/110 or pressure differential 102/104, contrary to the aforesaid Kamatics patent.

The present invention has therefore overcome the prejudices of the prior art.

The cable will be inserted at one end of the flyer bow and will pass through the center of the turns in the guide element.

This guide element will be made removable by sliding out of the tunnel in order to facilitate its replacement or simply to clean out the debris and other dust.

The Applicant noted that, in entirely surprising manner, the cable guide element greatly reduced the wear of the cable (despite the increase of surface area in contact with the turns compared with that of U.S. patent '513, which is surprising), because the adjacent turns form a succession of "small bulges" and "small hollows" which, unexpectedly and according to the non-limitative theory of the Applicant, reduce the rebound effect of the cable against the walls of traditional guide elements while generating contacts of the cable here and there rather than continuous friction, with the consequence of much less wear and therefore much less debris.

Since the spacing of the turns of the spring is almost zero, it does not affect the precision of the step of assembly of the cable. Since the rebound effect is less, the impacts suffered by the cable are lessened and therefore so is its wear. Since the quantity of debris is very clearly reduced in this way, this debris no longer has to be eliminated continuously as in U.S. patent '513. A large savings is also achieved with regard to the loss of mass of the cable, wire or strand ("cable").

This is all the more important because of the fact that the device of flyer bow type rotates at very high speed and that the cable itself also travels at great speed.

By "almost zero spacing" between the turns of the guide spring, what is meant here is entirely preferably a zero spacing ("adjacent" turns), which may nevertheless tolerate very small spacings, in other words spacings so small that in no case will they leave debris free or permit it to slip between the turns. The spirit of the invention is therefore a "zero" spacing that is capable of tolerating minimum manufacturing imperfections, for example of accidental type.

By rejecting the teaching of U.S. patent '513, the present invention reduces not only wear of the cable but also its freedom to "flap" in the guide, therefore greatly reducing vibrations, impacts and production of debris. Each aspect taken separately is surprising, and the combination of these advantages is even more so.

Of course, it will be noted that the invention is based on "cable" guide (or referred to globally as a "guide element"), the internal surface of which is formed by "micro bulges" alternating with "micro hollows". A spring with closed or "adjacent" turns has been described hereinabove as being the best embodiment at present, but any internal guide tube, not necessarily a spring, may be envisioned, provided that its internal surface is formed by micro bulges alternating with adjacent micro hollows.

DETAILED DESCRIPTION OF THE INVENTION

The invention therefore relates to a flyer bow of the type described hereinabove, the essential characteristic of which lies in a "cable" (wire, strand, cable, etc.) guide element for a flyer bow for assembling/twisting/braiding of "cable" surrounding the "cable" at least partly or completely with a body (C), the said flyer bow being provided with a longitudinal orifice or "internal tube" (O) made in the mass of the said body (C) and over the entire length of the said flyer bow. A "cable" guide element (EG) is accommodated in the said orifice (O) in order to guide the longitudinal travel of the "cable" therein. The said "cable" guide element (EG) presents its internal surface (SI) defining the "cable" channel (PF) formed by micro bulges (MB) alternating with "adjacent" micro hollows (MC).

Preferably the guide element (EG) completely surrounds the "cable".

Figure 9:
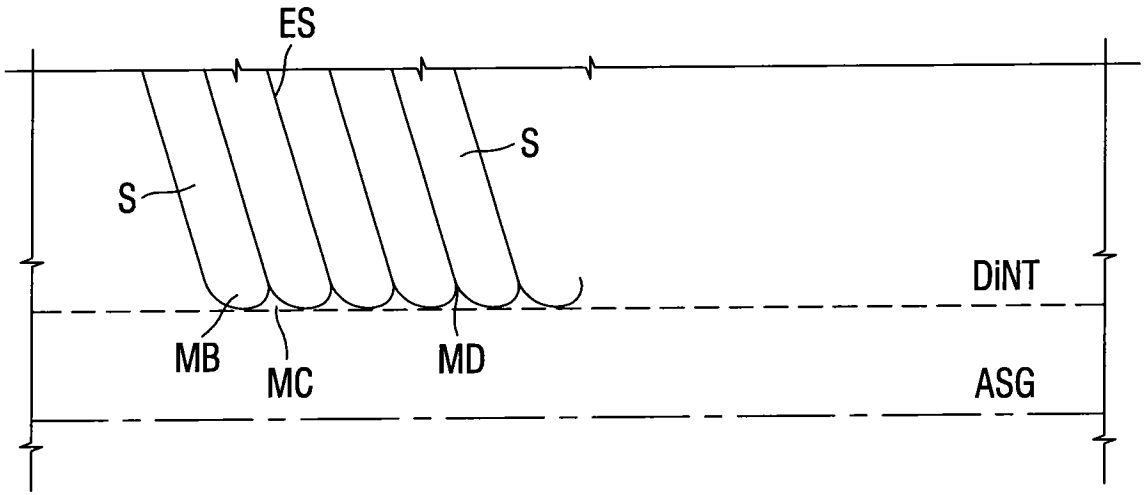
FIG. 9 illustrates a longitudinal section of the cable guide.

Such micro bulges (MB) and alternating "adjacent" micro hollows (MC) are represented on the attached FIG. 9.

The order of magnitude (in height) of the micro hollows and bulges ranges from 0.1 to 0.3 mm and may be as large as 1 mm.

Entirely preferably, the said "element" is actually of the type of a spring with "closed" turns, meaning without space between them, the turns therefore being "adjacent" and therefore having "almost zero" (see definition hereinabove) or preferably zero spacing.

In the usual case in which the "cable" is of copper, micro deposits (MD) of copper debris may accumulate in the micro hollows (MC). Surprisingly, these micro deposits, undoubtedly by virtue of their miniscule volume, do not in any way detract from the advantages mentioned hereinabove; it has also been noted that they were dislodged by the travel of the cable and that their very low mass ensured that even their evacuation did not perturb the system.

According to one possible theory, these micro deposits even have a "smoothing" effect on the internal surface (SI) of the guide, thus limiting even more the rebounds of the cable.

According to a preferred but non-limitative embodiment, the flyer bow will be made of carbon/epoxy fiber.

The guide element will preferably be of steel.

The Applicant has noted a very distinct reduction, as large as 35%, of electrical consumption of the flyer bow motor, associated directly with the reduction of the aerodynamic drag.

The Kamatics profile of U.S. patent '513 ("airfoil" or airplane wing) would be even more favorable.

However, the ovoid and symmetric profiles according to the invention have the very useful feature in practice of permitting the use of the machine in clockwise or counter-clockwise mode without having to dismantle it.

A reduction of noise due to the said reduction of drag may attain −2.5 dB at high speed (see Table 1).

TABLE 1

| | Flyer bow speed % | |
|---|---|---|
| | 80% | 100% |
| Flyer bow according to the present invention | 75.8 | 81.3 |
| Standard flyer bow | 77.7 | 83.8 |

An improvement of the resistance per unit length of the cables (in other words a reduction of the losses of diameters) is also observed.

Figure 10:
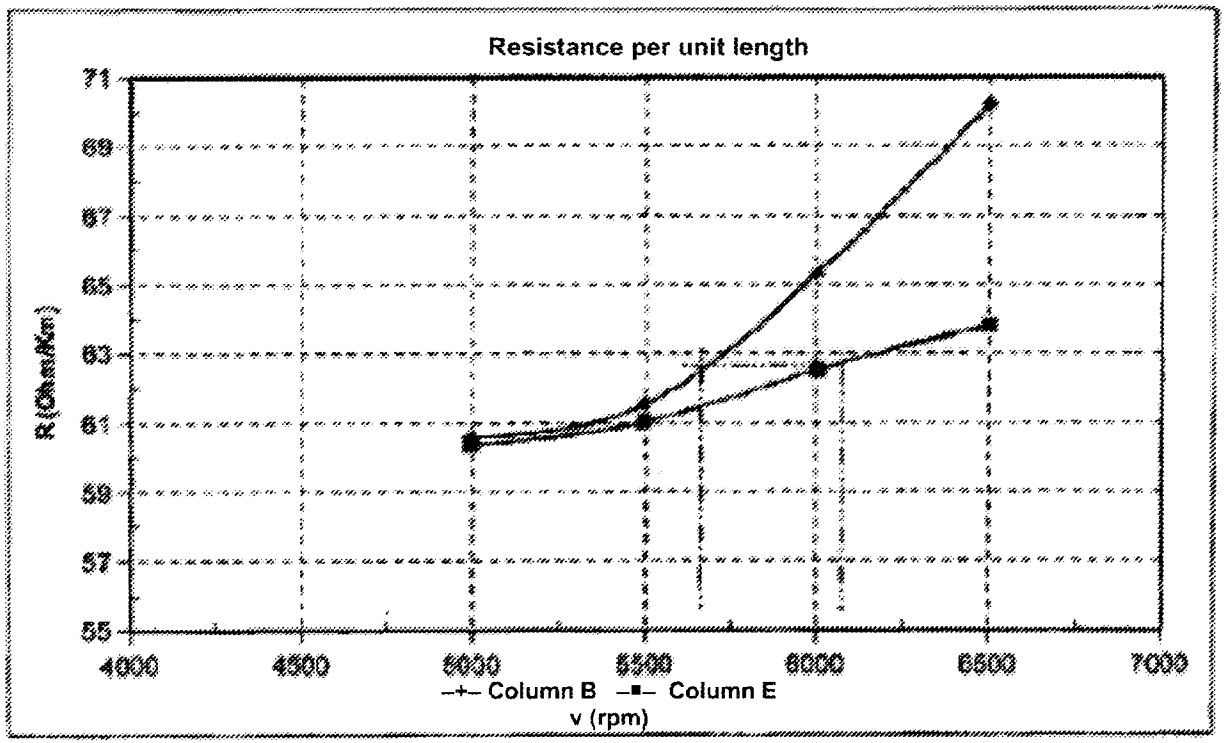
FIG. 10 illustrates a graph showing measurements of resistance per unit length.

FIG. 10 illustrates the measurement of the resistance per unit length (see detail in Table No. 2).

Analysis:

The measurements are similar at 5000 rpm, but above there is a distinct advantage in favor of the flyer bow according to the present invention: micro-bulge effect of the spring when the wire is centrifuged. For example, production at 5700 rpm with the standard flyer bow may be achieved at 6100 rpm with the same final product quality (i.e. a 7% productivity gain).

Column E represents the flyer bow according to the present invention.

Column B represents a standard flyer bow.

Resistance Per Unit Length

TABLE 2

| | Eyelet | | Flyer bow according to the present invention | | | |
|---|---|---|---|---|---|---|
| Speed | R (Ω/km) | Temperature | R (Ω/km) | Temperature | Delta % | Delta |
| 5000 | 60.55 | 17.5 | 60.35 | 17.5 | −0.33 | −0.199999999999996 |
| 5500 | 61.5 | 17.5 | 61 | 17.5 | −0.81 | −0.5 |
| 6000 | 65.3 | 17.5 | 62.5 | 17.5 | −4.29 | −2.8 |
| 6500 | 70.2 | 17.5 | 63.8 | 17.5 | −9.12 | −6.40000000000001 |

It is also possible to envision placing a reinforcing and protective element (EP) in the internal tube or orifice (O) (in other words, the tubular conduit made in the thickness of the flyer bow), between the said internal tube and the cable guide element (RS). This reinforcing element will have the function of protecting the guide element and cushioning the impacts to which it is subjected.

The said protective element (EP) is preferably a carbon tube installed during production of the flyer bow.

DRAWING AND NON-LIMITATIVE EXEMPLARY EMBODIMENTS

These characteristics, and elements employed, will be better understood by reading the attached FIGS. 1 to 9.

FIG. 1 represents in known manner a rotating flyer bow 1 with an entry and an exit for the cable, wire or strand.

Figure 3A:
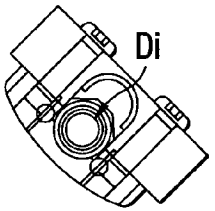
Fig. 3A PRIOR ART
FIG. 3*a* illustrates a cross-sectional view of the cable entry.
Figure 3:
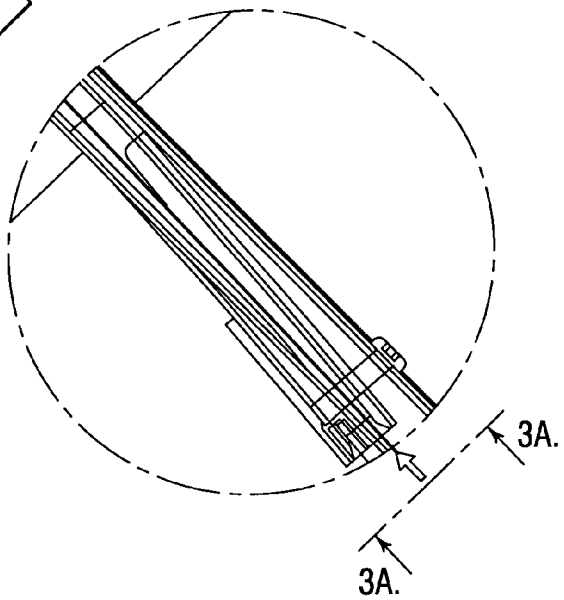
Fig. 3 PRIOR ART
FIG. 3 illustrates a detailed arrangement of the cable entry.
Figure 2A:
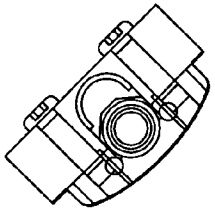
Fig. 2A PRIOR ART
FIG. 2*a* illustrates a cross-sectional view of the cable exit.
Figure 2:
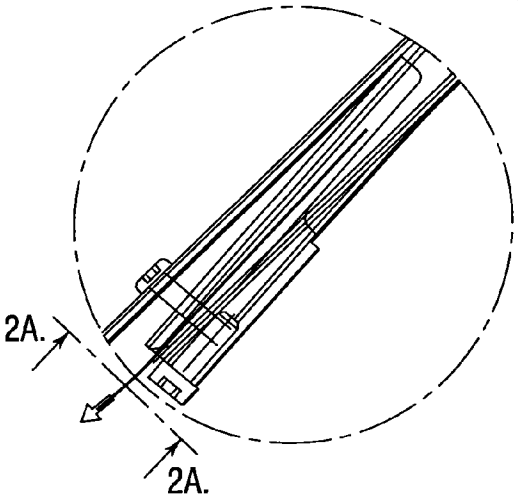
Fig. 2 PRIOR ART
FIG. 2 illustrates a detailed arrangement of the cable exit.

FIGS. 2 and 2*a* as well as 3 and 3*a* respectively represent the detailed arrangements of the cable exit and entry zones, as well as (FIGS. 2*a* and 3*a*) the respective cross sections through 2A-2A and 3A-3A respectively of these mechanical arrangements well known in themselves.

Figure 4:
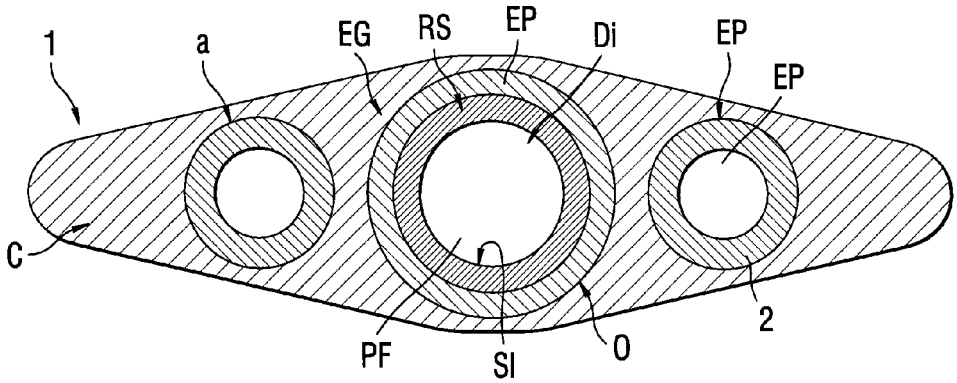
FIG. 4 illustrates a cross-sectional view of an exemplary embodiment of the flyer bow.
Figure 5:
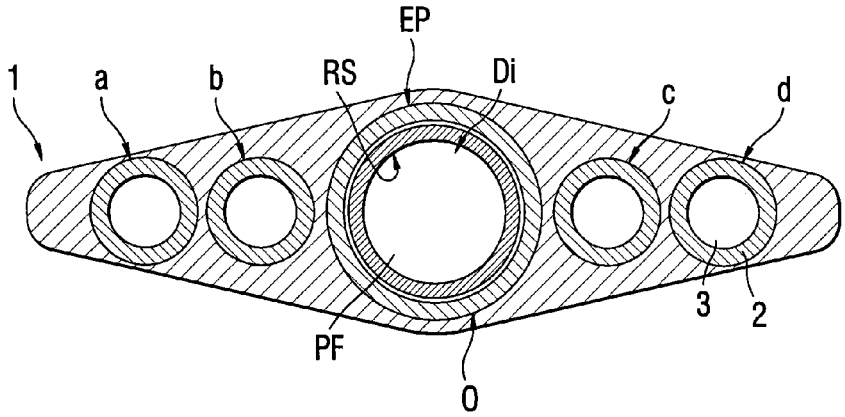
FIG. 5 illustrates a cross-sectional view of another exemplary embodiment of the flyer bow.
Figure 6:
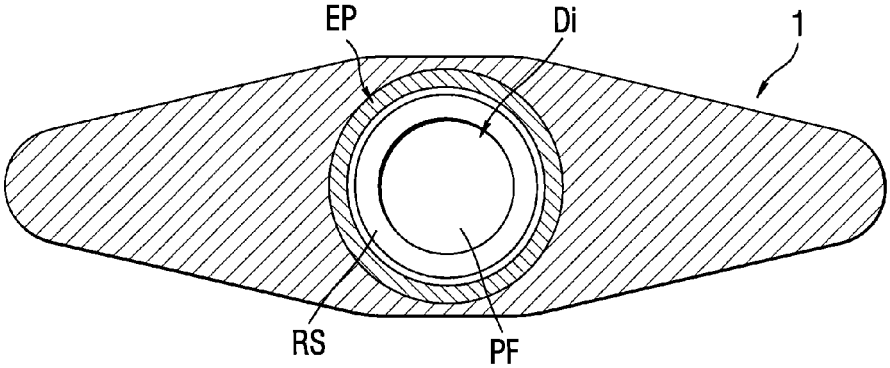
FIG. 6 illustrates a cross-sectional view of another exemplary embodiment of the flyer bow.

FIGS. 4, 5 and 6 represent cross sections through three non-limitative embodiments of a flyer bow according to the invention. These figures show a flyer bow cross section of the shape referred to here as symmetric "ovoid", which is the preferred shape. It is seen that it is symmetric and not in the shape of an "airfoil" or airplane wing, and therefore it permits a change in the direction of rotation of the flyer bow.

These figures are three sections through 4-4 of FIG. 1.

As already indicated, any globally ovoid and symmetric shape is suitable and is preferred, although in certain cases it is possible to accept a cross section of "airfoil" or airplane wing shape, or any other shape that favors entry into the flyer bow in the air at high speed of rotation.

FIG. 4 distinctly shows two lateral and obviously symmetric recesses (a) and (b); the recess itself is visibly the tubular center (3) that will pass all along the flyer bow. An optional protective element (2) may be adjoined thereto. The objective is to make the flyer bow as lightweight as possible, naturally depending on the inside diameter (Di), which is the diameter of the cable. FIG. 4 is appropriate especially for a Di of 4.7 mm.

Also on FIG. 4 there has been shown the preferred embodiment of the invention, where the guide for the cable (or wire, strand, etc.), in this case the preferred embodiment, which is a spring with adjacent turns (RS), is disposed adjacent to a protective tube (EP), itself accommodated in precise manner during mounting in the tubular orifice (O) made in the entire length of the flyer bow.

It has been seen that this protective element (EP) was optional but very clearly preferred for the technical reasons indicated.

The grouping obviously leaves the channel for the cable or wire or strand, etc. (PF) free, the "cable" not being represented so as to avoid overloading the figures.

PF is naturally determined by Di, which itself is adapted as a function of the outside diameter of the "cable", which is very slightly smaller than Di, in the manner known for reduction of friction between the "cable" and (RS) and also to permit only very slight flapping of the "cable".

The "play" between the outside diameter of the cable and Di will be at least 0.6 mm-0.8 mm and depends on the cable. It will be easy for the person skilled in the art to define the optimum value. A maximum value will be from 3-3.5 mm, preferably 0.8-1.5 mm, depending on the actual cables.

FIG. 5 is totally comparable with FIG. 4 except that it is provided with 4 lateral recesses (a, b and c, d). Such an arrangement is suitable, for example, for a cable diameter Di of 8 mm.

FIG. 6 is also comparable with FIGS. 4 and 5, except that it is not provided with lateral recesses of type (a, b, etc.); as indicated, these recesses are not obligatory, because their purpose is to lighten the mass of the rotating flyer bow and therefore to decrease both the centrifugal force of the flyer bow and the necessary motor power.

Figure 7:
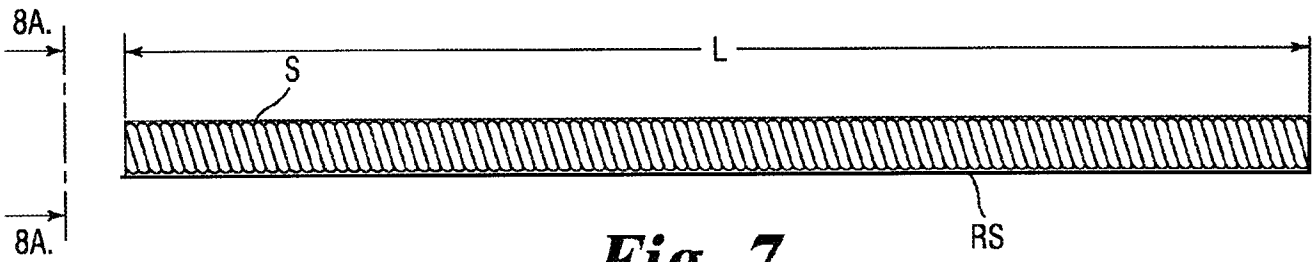
FIG. 7 illustrates an exemplary embodiment of a cable guide system.

FIG. 7 represents the "cable" guide system and shows the adjacent turns (S) separated by a zero interval or spacing.

Figure 8B:
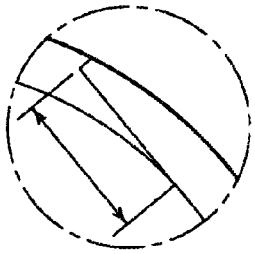
FIG. 8*b* illustrates an enlarged view of FIG. 8*a*.
Figure 8A:
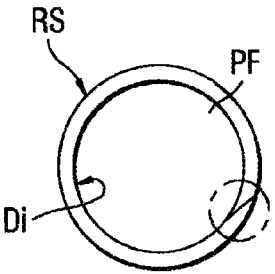
FIG. 8*a* illustrates a cross-sectional view of FIG. 7.

FIG. 8 is composed of FIG. 8*a*, which is the cross section through 8A-8A of FIG. 7, and of FIG. 8*b*, which is (circle and arrow) an enlarged view of the position of the "point" created when the spring is cut, which point must be positioned (during mounting) so that the wire is not able to flap above it during its travel. In other words, this "point" is "polished" manually to reduce its sharpness as much as possible.

The same references represent the same elements or measures as in the preceding figures, and L is the length of the cable guide element.

FIG. 9 represents a longitudinal section of the cable guide (RS) in the form of a spring with "adjacent" turns (S) having zero interval or spacing (ES). This figure is intended to show the micro bulges (MB), while the micro hollows MC are situated at the inside diameter (Di) of the guide RS, naturally with the axis of symmetry of the guide RS in rotation, denoted by ASG.

FIG. 10 illustrates the measurement of the resistance per unit length.

The micro deposits (MD) from the very small quantity of debris produced by the cable during its travel in the channel for the cable or wire or strand, etc. (PF) also is noted.

The person skilled in the art naturally will know how to calculate and apply all of the tolerances between the parts, for example the compromise between friction and flapping, as well as the tolerances on the tube and spring diameters, so as to achieve the best compromise between interchangeability and maintenance of position.

The invention also covers flyer bows for assembly/twisting/braiding of cables and/or twisting of wires, characterized in that it is provided with at least one "cable" guide element such as described hereinabove.

The invention also covers all the embodiments and all the applications that will be directly accessible to the person skilled in the art upon reading the present application and from his own know-how.

The invention claimed is:

1. A cable (wire, strand, cable, etc.) guide element for a flyer bow for assembling or twisting of cable surrounding the cable at least partly or completely comprising:

a body (C), the said flyer bow being provided with a longitudinal orifice or internal tube (O) made in the mass of the said body (C) and over the entire length of the said flyer bow, and a cable guide element (EG) is accommodated in the said internal tube (O) in order to guide the longitudinal travel of the cable therein, wherein prior to insertion of the cable guide element into the internal tube (O), an internal surface (SI) of the cable guide element (EG) defining a cable channel (PF) is formed by micro bulges (MB) alternating with micro hollows (MC) and there is substantially zero spacing between the micro bulges (MB) and the micro hollows (MC).

2. The cable guide element according to claim 1, wherein the cable guide element (EG) is a spring (RS).

3. The cable guide element according to claim 1, further comprising a tubular protective element (EP) disposed between the internal tube (O) and an exterior surface of the cable guide element (EG).

4. The cable guide element according to claim 3, wherein the protective element (EP) is made of carbon.

5. The cable guide element according to claim 1, wherein a gap between an outside diameter of the cable and Di (inside diameter of the guide element (EG)) ranges from at least 0.6-0.8 mm to 3-3.5 mm.

6. The cable guide element according to claim 1, wherein micro deposits (MD) of cable debris, are able to accumulate in the micro hollows (MC).

7. The cable guide element according to claim 1, wherein the order of magnitude (in height) of the micro hollows (MC) and micro bulges (MB) ranges from 0.1 to 0.3 mm.

8. A flyer bow for assembling or twisting of cables, wherein it is provided with at least one cable guide element according to claim 1.

9. The flyer bow according to claim 8, wherein said flyer bow is made of carbon/epoxy fibers.

10. The flyer bow according to claim 8, wherein said flyer bow has a symmetric ovoid cross-sectional profile.

11. The flyer bow according to claim 8, wherein said flyer bow is additionally provided with 2 to 4 symmetric bilateral recesses (a), (b), (c), (d).

12. The cable guide element according to claim 1, wherein a gap between the outside diameter of the cable and (Di) (inside diameter of the guide element (EG)) ranges from 0.8-1.5 mm.

13. The cable guide element according to claim 1, wherein micro deposits (MD) of copper cable debris, are able to accumulate in the micro hollows (MC).

14. The cable guide element according to claim 1, wherein the order of magnitude (in height) of the micro hollows (MC) and micro bulges (MB) ranges from 0.1 to 1.0 mm.

15. A cable (wire, strand, cable, etc.) guide element for a flyer bow for assembling or twisting a cable surrounding the cable at least partly or completely comprising:

a body (C), the said flyer bow being provided with a longitudinal orifice or internal tube (O) made in the mass of the said body (C) and over the entire length of the said flyer bow, and a cable guide element (EG) is accommodated in the said orifice (O) in order to guide the longitudinal travel of the cable therein, wherein the cable guide element (EG) is a spring (RS) with closed turns, and wherein an internal surface (SI) of the cable guide element (EG) defines a cable channel (PF) that is formed by micro bulges (MB) alternating with adjacent micro hollows (MC).

16. The cable guide element according to claim 15, wherein an internal surface of the cable guide element (EG) has a spacing (ES) between turns (S) that is zero.

* * * * *